United States Patent [19]

Abrams

[11] 4,395,296

[45] Jul. 26, 1983

[54] THERMAL MECHANICAL PROCESS FOR STEEL SLABS AND THE PRODUCT THEREOF

[75] Inventor: Halle Abrams, Allentown, Pa.

[73] Assignee: Bethlehem Steel Corporation, Bethlehem, Pa.

[21] Appl. No.: 276,103

[22] Filed: Jun. 22, 1981

[51] Int. Cl.[3] ..... C21D 8/02

[52] U.S. Cl. ..... 148/12.4; 148/39

[58] Field of Search ..... 148/12.4, 12 R, 12 F, 148/36, 39

[56] References Cited

U.S. PATENT DOCUMENTS 2,356,450 8/1944 Epstein ..... 75/123

3,897,279 7/1975 Shaughnessy et al. ..... 148/12 F

FOREIGN PATENT DOCUMENTS 135615 10/1979 Japan ..... 148/12 C

OTHER PUBLICATIONS

Fegredo, "Hold-Period Accelerated Cooling Experiments or Nb-, and Ti-HSLA Steels", Metals Technology, Sep. 1977, pp. 417-424.

Heedman et al., "Controlled Rolling of Plates with Forced-Water Cooling during Rolling", Metals Technology, Sep. 1981, pp. 352-360.

Mangonon, Jr. et al., "Subgrain and Precepitation-Strengthening Effects in Hot-Rolled, Columbium-Bearing Steels," Micro Alloying 75, Wash. D.C., Oct. 1975, pp. 49-60.

*Primary Examiner*—Peter K. Skiff

*Attorney, Agent, or Firm*—John I. Iverson; William B. Noll

[57] ABSTRACT

This invention is directed to a thermal-mechanical process, and to the product thereof, for treating carbon or low alloy steels to improve their strength and toughness. The process is chracterized by the steps of austenitizing a carbon or low alloy steel workpiece, preferably in the form of a slab, reducing said slab at a temperature above about 1900° F. (1038° C.) to a thickness in the range of 2 to 4 inches (5.1 to 10.2 cm), controlled quenching to effect thermal equilibration until a surface-to-center thermal gradient within a temperature range of 50° to 150° F. (28° to 83° C.) is reached, and initiating working such control quenched workpiece at an average temperature within the range of 1450° to 1750° F. (788° to 954° C.). The reduced steel product, having been treated in accordance with said thermal-mechanical process to yield a rolled steel plate having a thickness between about 0.5 to 1.25 inches (1.3 to 3.2 cm), is characterized by a fine-grained microstructure that is essentially grain size symmetrical from the center to the surface, with a grain size difference on the order of about 1 ASTM number, center to sub-surface, and by improved strength and toughness.

4 Claims, 4 Drawing Figures

THERMAL MECHANICAL PROCESS FOR STEEL SLABS AND THE PRODUCT THEREOF

BACKGROUND OF THE INVENTION

This invention is directed to a thermal-mechanical process, and to the product thereof, for treating carbon or low alloy steels to improve their strength and toughness. Metallurgists have for year attempted to improve the mechanical properties of rolled steel products through combinations of thermal-mechanical treatments and through specially engineered quenching cycles. A major failure of these practices has been the absence of a commercially viable practice. Continuum rolling, as represented by U.S. Pat. Nos. 3,645,801 and 3,826,691, is a good example of a recent thermal-mechanical practice to improve mechanical properties of rolled steel products, but which has limited commercial application.

Continuum rolling, as defined by such patents, covers a thermal-mechanical process wherein a steel workpiece is subjected to a rolling sequence which includes rolling said workpiece while it is austenitic, followed by further rolling within the austenite-ferrite, and ferrite regions to product a steel which is highly textured in microstructure.

Controlled rolling is a variation of continuum rolling in that all working is concluded in the austenite-ferrite region. U.S. Pat. No. 3,806,378 graphically illustrates the controlled rolling treatment sequence along with other thermal-mechanical treatments which have been developed over the years. A major drawback of these thermal-mechanical treatments is the inherent time delays necessary to equalize temperatures of the steel workpiece. Though the properties of the resulting steel reveal useful and valuable characteristics, the practices are not suited for commercial mills where tonnage production is a necessary factor to develop a marketable product.

There have been other patented developments in the area of thermal-mechanical treatments. For example, U.S. Pat. No. 4,088,511 teaches a thermal-mechanical treatment for improving the properties of carbon and low alloy steels. The method taught therein includes rapidly heating to partially austenitize a steel workpiece to develop a ferrite-austenite mixture, quenching to render the austenite metastable, equalizing the temperature throughout the steel workpiece, followed by mechanical working. Another example of a thermal-mechanical treatment is taught in U.S. Pat. No. 4,040,872. The patent discloses a process which includes austenitizing, quenching, mechanical working below the lower critical temperature, and stress relieving.

Efforts by metallurgists engaged in research have not been restricted to purely thermal-mechanical treatments; they have sought to improve properties and structure through post-working heat treatments.

Several patents, described below, teach heat treating methods for developing differences in through thickness properties and structures. U.S. Pat. No. 4,165,246 teaches a method for austenitizing and quenching thick-walled steel pipe to develop martensite in the outer layers thereof but not in the non-quenched wall parts, followed by tempering the martensitic outer layers by residual heat from the inner wall layers. U.S. Pat. Nos. 4,016,009 and 4,016,015 teach similar practices in which a steel rod or bar are hot rolled, surface quenched after the hot mill finishing stand to produce a surface layer of martensite or bainite, followed by slow cooling to develop a modified core structure and a tempered surface layer.

The present invention is the culmination of a research investigation to improve the properties of carbon or low alloy steels by means commercially attractive to steel producers. Such investigation was successful as will be made apparent by the description which follows.

SUMMARY OF THE INVENTION

This invention is directed to a thermal-mechanical process for treating carbon or low alloy steels to improve their strength and toughness. Further, this invention is directed to the unique steel product resulting therefrom.

The process is characterized by the steps of austenitizing a carbon or low alloy steel workpiece, preferably in the form of a slab, reducing said slab at a temperature above about 1900° F. (1038° C.) to a thickness in the range of 2 to 4 inches (5.1 to 10.2 cm), controlled quenching to effect thermal equilibration until a surface-to-center thermal gradient within a temperature range of 50° to 150° F. (28°to 83° C. ) is reached, and initiating working such control quenched workpiece at an average temperature within the range of 1450° to 1750° F. (788° to 954° C.). Finishing working is preferably conducted at a temperature within the range of 1250° to 1600° F. (677° to 871° C.). In a preferred microalloyed form such as V-Cb steel, the resulting product is a steel plate having a thickness between about 0.5 to 1.25 inches (1.3 to 3.2 cm), a tensile strength of at least 85 ksi, and a toughness, as measured by charpy V-notch, of at least $Cv_{15}=-25°$ F.

The finish rolled steel workpiece of this invention is characterized by a fine-grained microstructure that is essentially grain size symmetrical from the center to the surface, with a grain size difference on the order of about 1 ASTM number, and by levels of strength and toughness at least as good as the levels produced on comparable steels under conventional controlled-rolling practices.

BRIEF DESCRIPTION OF DRAWINGS

FIG. 4 is a comparison of grain size profiles for 0.750" low alloy steel plates processed according to the teachings of this invention, and according to conventional control rolling techniques.

DETAILED DESCRIPTION OF PREFERRED EMBODIMENT

This invention is directed to a thermal-mechanical process, and to the product thereof, for treating carbon or low alloy steels to improve their strength and toughness. Thermal-mechanical treatments of steel have long been known as a means of improving the mechanical properties of such steels. One such well-known treatment is controlled-rolling. However, associated with the optimum controlled rolling schedules is an inherent productivity loss. This loss in productivity is mainly due to the hold time at the intermediate transfer gage, waiting for the slab to cool to the proper start rolling temperature. Thus, a penalty to be paid for the improved mechanical properties by these prior art thermal-mechanical processes is a loss in productivity.

The concept of this invention resides in the discovery that significant improvements can be achieved by means of a thermal-mechanical process without the normal attendant loss in productivity. In other words, the invention as described and claimed herein represents a process which can be practiced on a commercial scale to produce an improved but marketable product.

Figure 3A:
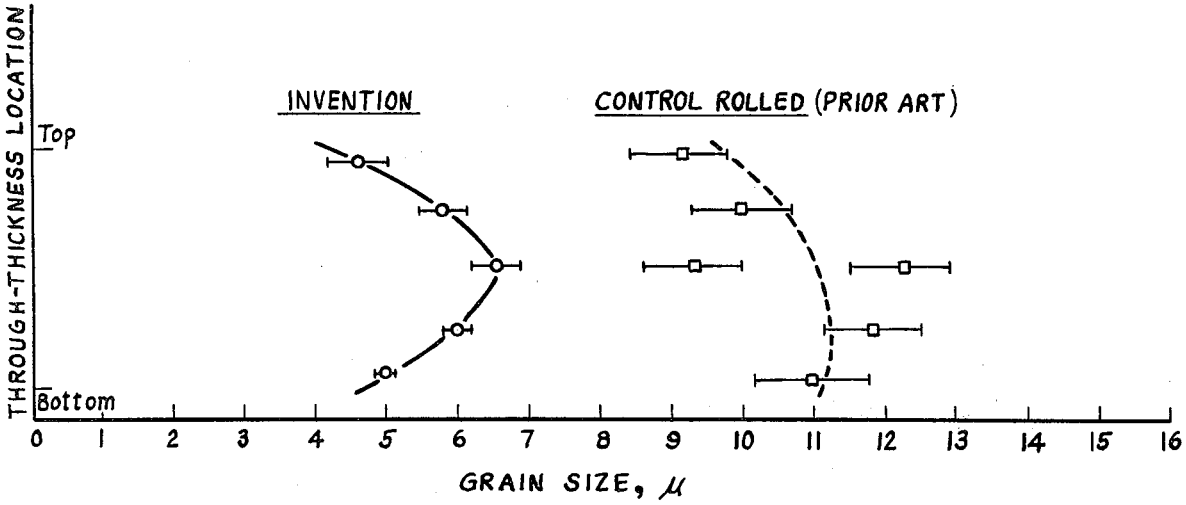
FIG. 3 is a graph illustrating the preferred range of accelerated cooling parameters, utilizing a specific nozzle geometry, for carrying out the process of this invention.
Figure 1:
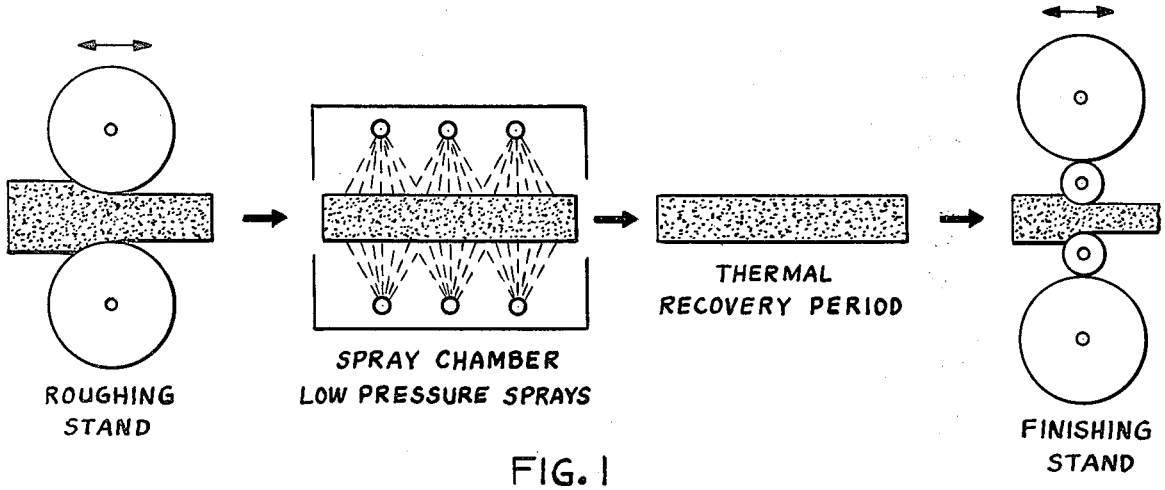
FIG. 1 is a schematic flow chart illustrating the accelerated cooling/rolling process according to this invention.

A schematic of a preferred accelerated cooling/rolling process according to this invention is shown in FIG. 1. The austenitized and partially rolled steel slab from the roughing stand is subjected to low pressure water sprays of 20 to 100 psi at appropriate flow rates and nozzle geometries to achieve heat transfer coefficients (HTC) of from 200 to 600 Btu/hr-ft$^2$-°F. The HTC, a process parameter independent of steel composition and temperature, is a function of the (a) water flow rate, (b) spray pressure, (c) plate area to be sprayed, and (d) nozzle geometry.

The spray may be applied for 10 to 15 seconds depending on the slab thickness and average roughing stand exit temperature, followed by a thermal equilibration time of 30 to 60 seconds. Mechanical working is then resumed with average slab temperatures of 1450° F. to 1750° F., with a through-thickness thermal gradient of 50° to 150° F. center to surface. The finish rolling temperatures are in the range from 1250° F. to 1600° F.

Figure 2:
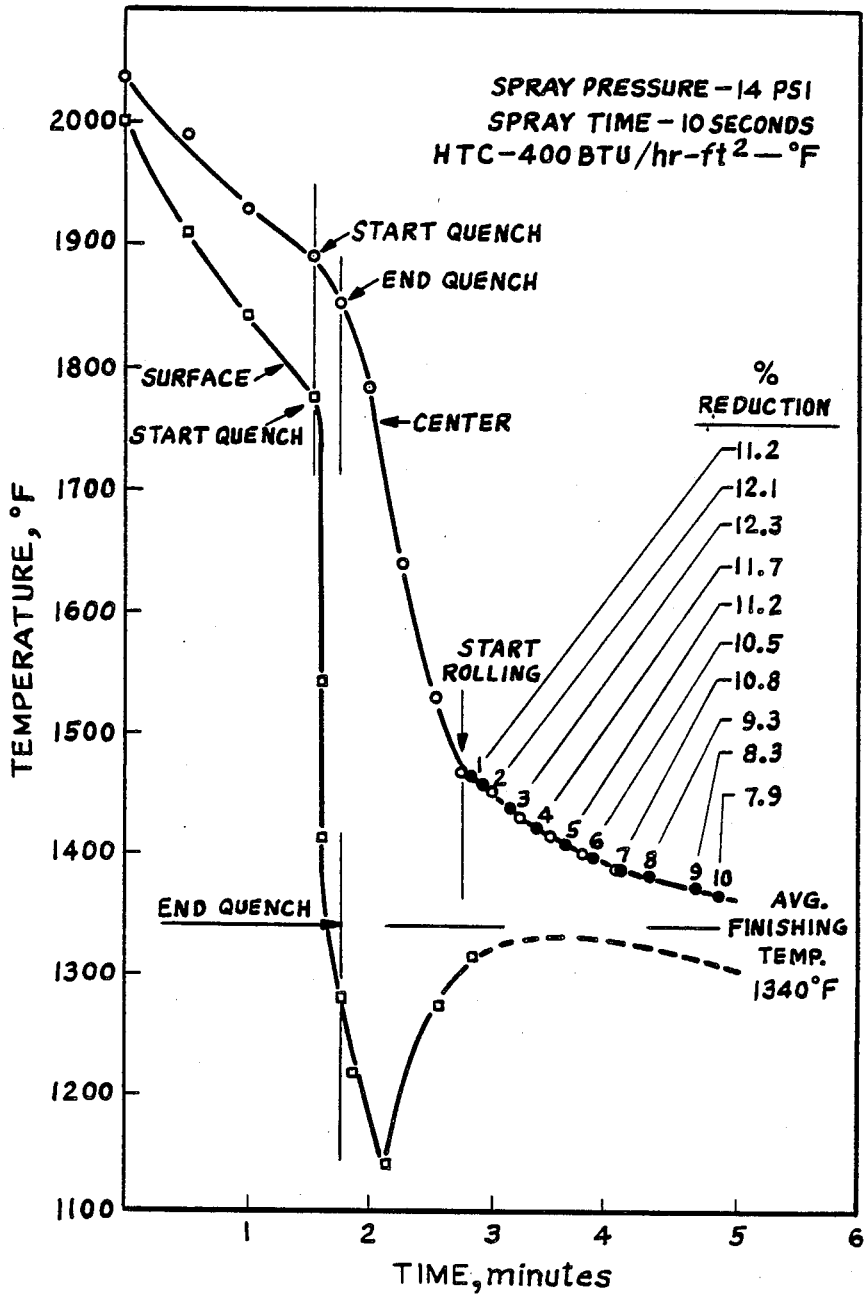
FIG. 2 is schematic diagram showing time-temperature-deformation interactions of a preferred practice for carrying out the process of this invention.

The process according to this invention may be illustrated in a different manner, namely, the schematic representation of FIG. 2. Such FIGURE shows the time-temperature-deformation interactions of a carbon or low-alloy steel processed by this invention.

A carbon or low alloy steel, typically about 6" to 8" (15.2 to 20.3 cm) thick, is austenitized at a temperature of about 2,250° F. (1232° C.). Thereafter, the slab is reduced in thickness to about 2.50 to 3.25" (6.4 to 8.3 cm), depending on final thickness desired, on a roughing stand. The average exit temperature from said roughing stand is between 1900° and 2000° F. (1038° to 1093° C.). As shown in FIG. 2, the brief quenching cycle is initiated under controlled conditions at an average temperature of about 1850° F. (1010° C.). The accelerated cooling or controlled quenching is such as to effect thermal equilibration until a surface-to-center thermal gradient of 50° to 150° F. (28° to 83° C.) is achieved. As shown in FIG. 2 the surface temperature of the slab is rapidly reduced to just above 1100° F. (593° C.), a preferred minimum temperature being no less than about 1000° F. (593° C.). This assures that the near surface layer of the slab preferably does not cool below the $Ar_1$ temperature. However, the absolute minimum temperature for the near surface layer is the $M_s$, the temperature below which martensite will form upon cooling. Rather quickly after termination of the quenching cycle, residual heat from the center of the slab begins to raise the surface temperature, where the slab, upon reaching a center-to-surface gradient of between 50° to 150° F. (28° to 83° C.), final working of the slab is initiated. The average working temperature is between about 1450° to 1750° F. (788° to 954° C.). The resulting slab, which prior to quenching had a thickness between 2.50 to 3.25" (6.4 to 8.3 cm), will have a thickness of about 0.50 to 1.25" (1.3 to 3.2 cm), and an average finishing temperature between about 1250° to 1600° F. (677° to 871° C.), typically about 1340° F. (726° C.).

In order to achieve the desired productivity gains attributable to this invention, as well as a quality metallurgical product, the parameters of the quenching cycle must be selected to achieve an HTC of from 200 to 600. The HTC is dependent on a spray force factor $$\frac{Q\sqrt{P}}{A},$$

where:

Q=water flow rate, gpm;

P=water pressure, psi;

A=area of slab being sprayed, ft$^2$.

Figure 3:
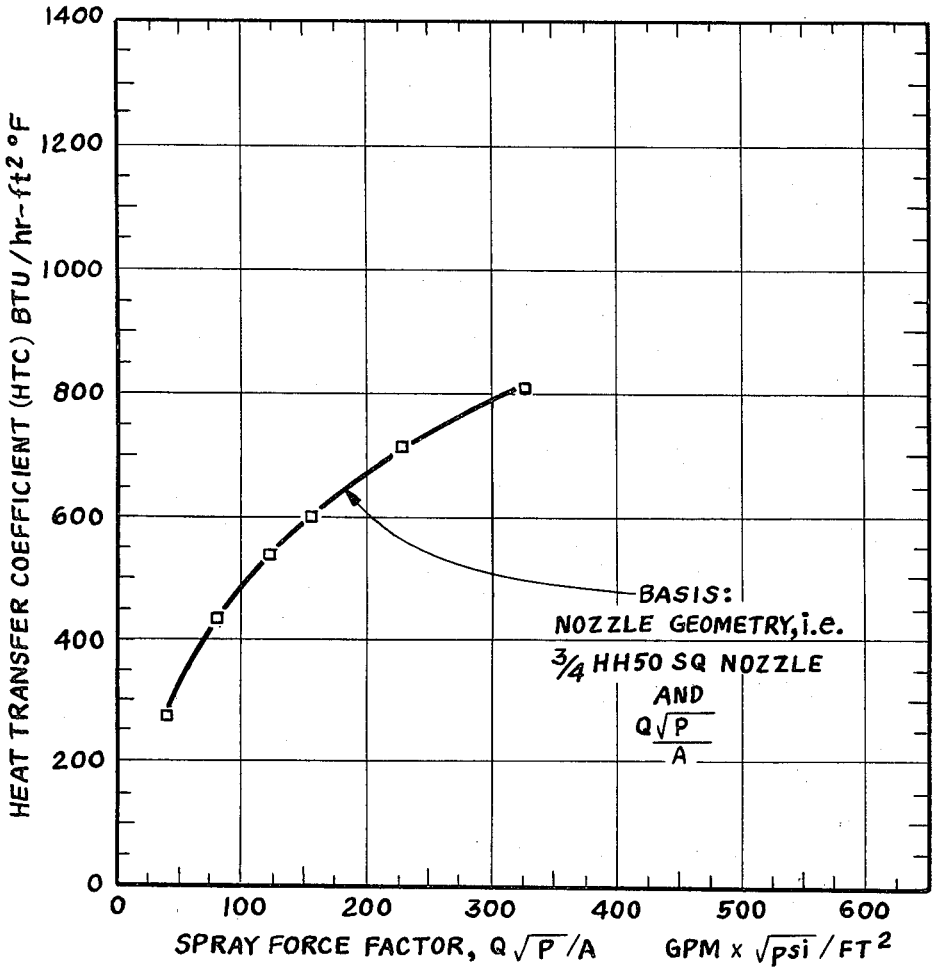

This relationship is shown in FIG. 3 and is based on the use of a nozzle identified as "¾ HH50 square nozzle."

To demonstrate the effectiveness of the above described thermal-mechanical process of this invention over conventional prior art practices, a series of plain carbon steel slabs were processed in accordance with (a) the invention, (b) controlled rolling, and (c) conventional hot rolling. A second series of low alloy steel slabs were processed in accordance with (a) the invention, and (b) controlled rolling. The two steels, processed as above, had the following chemistry:

| | Plain Carbon (PC) | Low Alloy (LA) |
|---|---|---|
| C | .11 | .11 |
| Mn | 1.52 | 1.41 |
| P | .016 | .017 |
| S | .005 | .009 |
| Si | .29 | .28 |
| Al | .034 | .056 |
| V | .007 | .068 |
| Cb | .005 | .036 |
| Fe | Bal. | Bal. |

TABLE I

MECHANICAL PROPERTIES[1]

| Type Steel | Processing Mode[2] | Final Plate (Ga.) | Y.S. (ksi) | T.S. (ksi) | Elong. (%) | $CV_{15}$ |
|---|---|---|---|---|---|---|
| PC | (a) | .747 | 59.0 | 80.8 | 32.0 | −50° F. |
| | | 1.245 | 52.5 | 77.0 | 33.5 | −50° F. |
| | (b) | .747 | 53.8 | 77.5 | 32.0 | −40° F. |
| | | 1.080 | 54.0 | 77.5 | 32.5 | −40° F. |
| | (c) | .742 | 47.2 | 77.8 | 30.8 | +15° F. |
| | | 1.223 | 43.9 | 76.5 | 29.3 | +15° F. |
| LA | (a) | .765 | 78.8 | 98.5 | 24.0 | −35° F. |
| | | 1.256 | 64.3 | 85.0 | 27.3 | −30° F. |
| | (b) | .765 | 65.5 | 86.3 | 27.0 | −35° F. |
| | | 1.255 | 58.5 | 81.8 | 27.3 | −10° F. |

[1]average of 2 tests
[2]Processing Mode:
(a) the invention,
(b) controlled rolling,
(c) conventional hot rolling Microscopic examination of the plates produced in accordance with the invention revealed that both the PC and LA grades had a fine ferrite-pearlite microstructure. A further discovery in the steels produced by the method of this invention is that such steels have a unique through-thickness microstructure. As shown in FIG. 4 the ferrite grain size in the center of the plate is about 6.5μ, whereas the sub-surface grain size is about 4.6μ. These grain size values translate respectively to ASTM No. 11.2 (center) and 12.2 (sub-surface). Thus, the ferrite grain size in the center of the processed plate is about one ASTM number coarser than the ferrite grain size near the surface. In addition, such examination showed that at the surface there was a layer of very fine non-equiaxed structure that appeared to be mostly lower transformation products. However, further investigation showed this surface layer to be ferrite-pearlite with an extremely well developed substructure, i.e. a well defined cell network within the grains. From FIG. 4 it is seen that the ferrite grain size is quite symmetrical center to surface and the surface grain size is much finer than could be achieved by conventional controlled rolling. The grain sizes for the control rolled plate varied between about 9.5 and 12$\mu$ (ASTM No. 10.1 and 9.4). The fine, symmetrical grain structure of the plate according to this invention is in sharp contrast to the larger non-symmetrical grain structure found in control rolled and conventionally hot-rolled plates. For purposes of comparison, the average grain size of conventionally hot-rolled steel plate is in excess of 20$\mu$.

The mechanical properties of the steels of this invention, as shown in Table I, are at least as good if not superior to the properties of comparable steels produced by controlled rolled and conventional hot-rolling. However, it must be noted that two processing variables, applicable to each of the three processing sequences, are the slab thickness prior to rolling and the final thickness. The latter is the more significant variable. Generally speaking, the strength (T.S. and Y.S.) of the processed steels decreases and the toughness decreases with increases in the final plate thickness. Thus, an accurate comparison of the respective processing sequences requires consideration of equal final gages, and preferably also the gage at the start of rolling. However, from the data of Table I it is possible to draw some general conclusions as to the superiority of the process and product of this invention.

For the PC grade, the conventionally hot rolled plates compared to the controlled rolled plates had lower yield strength (10 ksi on average), essentially equivalent tensile strengths, and poorer toughness ($CV_{15}$ about 60° F. higher on average and at 0° F. about 30 ft. lbs. less energy). For the same steel (PC), there is little difference in the strength and toughness between controlled rolled plates and the plates produced by this invention. Thus, insofar as this invention is compared to controlled rolling, the main advantage is productivity improvements. However, it is surmised that under mill conditions plates produced by this invention would have better mechanical properties than plates produced by conventional control rolling because of the finer grain size and unique microstructure of the product of this invention. Nevertheless, it is evident from the data of Table I that the method herein described and claimed can upgrade plain carbon steel grades to the 50–60 ksi yield strength range, with excellent notch toughness over the thickness range 0.5 to 1.5 inches (1.3 to 3.8 cm).

For the LA plates there is a difference in mechanical properties between control rolled plates and the plates produced according to this invention. Over the thickness range of 0.5 to 1.25 inches (1.3 to 3.2 cm) the yield strength of the LA plates of this invention are 6 to 12 ksi higher than the control rolled plates. The tensile strength difference is about 3 to 12 ksi and the $CV_{15}$ on average is about 40° F. lower and at 0° F. about 10 ft lbs more energy for the plates processed according to this invention as compared to the control rolled plates. This improvement in properties is associated with the overall finer grain size of the plates of this invention over the control rolled plates.

It will be understood that this invention is applicable to a continuous operation, such as for example, continuous casting of a steel slab, reheating the slab to the austenitizing temperature, and processing the slab by the thermal-mechanical cycle illustrated in FIG. 1. Alternatively, the preliminary steps may include an initial rolling followed by cooling to ambient temperature, provided that the slab is reheated to above about 2000° F. (1093° C.) prior to the controlled quenching and final rolling as described herein.

By way of example, following the latter practice of initially rolling and reheating a steel slab, a steel having a thickness of 2.50 inches (6.35 cm) and a chemistry as follows:

| C | Mn | Si | Al | S | Fe |
|---|---|---|---|---|---|
| .11 | 1.52 | .29 | .034 | .005 | bal. |

was heated to an average temperature of 2020° F. (1104° C.), the $\Delta T$ being about 40° F. (22° C.) from surface to center. For this example the slab was slowly cooled, such as by air, to the controlled-quench-average start temperature of about 1830° F. (999° C.). In a continuous opeation, this period of time, with the accompanying drop in temperature, would correspond to the initial rolling, typically on a 2-Hi Roughing Stand. In either case, at an average slab temperature of about 1830° F. (999° C.), where the $\Delta T$ has now broadened to about 110° F. (61° C.), the slab was control-quenched by a water spray for 10 seconds under a spray pressure of 14 psi to yield an HTC equal to 400. At the end of the quench the surface temperature had dropped to about 1220° F. (660° C.) while the center had cooled only about 40° F. (22° C.) down to 1850° F. (1010° C.). Even though the controlled quenching had ceased, the temperature continued to drop briefly before residual heat from the center began to reheat the surface. This period of thermal equilibration or recovery was continued until a surface-to-center $\Delta T$ of between 50° to 150° F. (28° to 83° C.) was reached. In this example, the start of rolling was commenced when the surface temperature was 1320° F. (715° C.) and the center temperature was 1470° F. (799° C.). The slab was subjected to a series of rolling steps, such steps varying between 7.9 and 12.3% reduction, until a final gage of 0.845" (2.15 cm) was achieved. The average finishing temperature was 1340° F. (727° C.). An examination of the steel plate, as processed above, revealed a unique through-thickness, symmetrical microstructure of ferrite-pearlite, the grain sizes being ASTM No. 11.3-center and ASTM No. 11.8-subsurface, and a surface layer of ferrite-pearlite with an extremely well developed substructure. Mechanically, the steel plate exhibited a transverse yield and tensile strength of 56.3 ksi and 79.2 ksi, respectively; and a notch toughness characterized by a $CV_{15}$ transition temperature of −45° F., and a shelf energy of 68 ft.lbs. at +32° F.

It will be understood that various changes and modifications may be made in the details of this invention without departing from the spirit and scope thereof, especially as defined by the following claims.

I claim:

1. In a thermal-mechanical process for treating a carbon or low alloy steel slab by a modified controlled rolling schedule to improve the strength and toughness properties of said steel slab, where such schedule includes a high temperature reduction of the steel slab, and quenching the steel slab to reduce the time for initiating a second low temperature reduction of the steel slab to final thickness, the improvement comprising in combination therewith the steps of (a) subjecting said steel slab to a high temperature reduction step at a temperature above 2000° F. (1053° C.), (b) quenching said steel slab from a temperature above about 1900° F. (1038° C.) by the application of low pressure water uniformly to the surfaces thereof, where the rate and time of application of said water is such as to achieve a heat transfer coefficient within the range of 200 to 600 BTU/HR-ft$^2$-°F., (c) ceasing said quenching prior to the surfaces of said steel slab reaching a temperature of about 1000° F. (539° C.) to avoid transformation of said steel slab to martensite, (d) holding said steel slab for a period of time to reduce the thermal gradient from surface to center thereof to a range of 50° to 150° F. (28° to 83° C.), (e) subjecting the steel slab to said second reduction at an average temperature of 1450° to 1750° F. (739° to 954° C.) to form a steel plate, and (f) cooling said steel plate to ambient temperature, whereby such plate is characterized by a fine-grained microstructure that is essentially grain size symmetrical from the center to the surface of the plate.

2. The process according to claim 1, characterized by the further improvement that said second reduction is finished at a temperature within the range of 1250° to 1600° F. (677° to 871° C.).

3. The process according to either one of claims 1 or 2, characterized by the further improvement that the thickness of said steel slab after the high temperature reduction is between about 2 to 4 inches (51 to 102 mm), and the final plate thickness is between about 0.5 to 1.25 inches (13 to 32 mm).

4. The process according to claim 3 characterized in that the ferrite grain size at the center of said steel plate is about one ASTM number coarser than the ferrite grain size near the plate surface.

* * * * *